US006108277A

United States Patent [19]

Whitmore

[11] Patent Number: 6,108,277

[45] Date of Patent: Aug. 22, 2000

[54] CELESTIAL TIMEPIECE ASSEMBLY

[76] Inventor: Keith Whitmore, 20410 SW. 126th Ave., Miami, Fla. 33177

[21] Appl. No.: 09/094,520

[22] Filed: Jun. 15, 1998

[51] Int. Cl.[7] ..... G04B 19/26; G04B 19/22; G04C 17/00

[52] U.S. Cl. ..... 368/15; 368/16; 368/21; 368/223

[58] Field of Search ..... 368/10, 15–20, 368/21, 83, 223, 228

[56] References Cited

U.S. PATENT DOCUMENTS

| | | | |
|---|---|---|---|
| D. 358,336 | 5/1995 | Mejaski . | |
| 3,925,917 | 12/1975 | Concha | 368/16 |
| 4,435,795 | 3/1984 | Frank . | |
| 4,671,669 | 6/1987 | Graves . | |
| 4,681,459 | 7/1987 | Nareyama et al. | 368/16 |
| 4,711,583 | 12/1987 | Oechslin et al. . | |
| 4,731,767 | 3/1988 | Uehara . | |
| 5,197,043 | 3/1993 | Strader . | |

*Primary Examiner*—Vit Miska
*Attorney, Agent, or Firm*—Malloy & Malloy, P.A.

[57] ABSTRACT

A timepiece and combined astrological display assembly including a casing which may be sized to resemble a wristwatch and a display assembly mounted on the casing and viewable through a display face. The display assembly is responsive to a processor sized to fit within the casing which includes or communicates with a plurality of databases, each of which is structured and disposed to store and depict different categories of information including, the current time of day at a given geographical location, as well as an ephemeris or other calendar and table which tracks the movement of various planets and celestial bodies, and the angular orientation between two planetary bodies for the determination of "Aspects" and/or a plurality of "Aspect" lines, each of which interconnects a selected pair of planetary bodies and provides forecasting astrological information. The processor includes memory capabilities structured for the storage of a single or multi year ephemeris, latitude and longitude indications for a plurality of predetermined geographic sites, and a conversion facility for converting Greenwich Mean Time to current local time dependent upon the plurality of predetermined geographic sites. A control assembly is also provided for inputting into the processor certain information relevant to the operability of the display assembly.

24 Claims, 4 Drawing Sheets

CELESTIAL TIMEPIECE ASSEMBLY

BACKGROUND OF THE INVENTION

1. Field of the Invention

The present invention relates to a timepiece, preferably in the form of a wristwatch to be mounted on the body of a user, which indicates among other things, the signs of the Zodiac and the positions of the sun and other planets, at any given time. More in particular, the present invention is directed towards a timepiece capable of selectively displaying a current local time, date and location, and further, a dynamic astrological chart based on the current local time and location, such that the user is aided in determining the likely outcome of a plurality of events or occurrences, based on the displayed astrological information, at any given time.

2. Description of the Related Art

The study of the sun, moon, other planets and the stars has been known and enjoyed by man since ancient times. Centuries ago, astrology and more in particular, the study of the movements of planets relative to a person's time of birth were considered to be controlling of the happenings and events during a person's life as well as the eventual outcome of a person's life. In modern times, astrology is becoming an increasing blend of both art and science. Astrologers or those involved in the interpretation of celestial or planetary movements and their impact on people around the world are consulted by people of all types and ages. Interest in astrology for purposes of determining the future and/or the outcome of various events are found not only in the curious, but even in more powerful and influential personages, including world leaders.

The determination of astrological events by the "reading" of the planetary positions and constellations of the Zodiac has historically meant long and tedious hours of calculation of the various planetary orbits and interpretation of that information. In addition, it has long been believed that in order to obtain a reliable horoscope or other pertinent astrological information a so-called "professional" involved in the computation and interpretation of such information must be consulted. While the interpretation of such astrological information is still best placed in the hands of a professional astrologer, the calculation and availability of such information is more easily accessed in contemporary times in that certain manuals have been developed, and software programs as well, to facilitate the computation of various stars and planet locations and orbits.

However, because of the increasing popularity of astrology and the belief that the determination of the outcome of future events can be predicted, there is still a need for a relatively small display assembly, such as a timepiece, which is capable of accurately presenting celestial information such as the movement and relative positions of the planets relative to a geographical location, as well as the current time and date for that locale.

Conventional techniques for displaying time are well known to all and include numerical displays, including rotating hands and the like, and digital displays. Clocks that display the phases of the moon or other features of the solar system are also known, but often are complicated in their construction. In addition, such attempts to provide celestial timepieces seem to rely more on appearance rather than substance, and consequently, are of questionable accuracy in terms of providing substantive astrological information. Further, it is believed that such known devices do not address the need for sturdiness which is typically required of a wearable timepiece.

Accordingly, there remains a need in the art for a combined timepiece and display assembly structured and disposed to display at least a current local time and date for a particular geographical location, as well as the astrological information for that particular geographical location, in sufficient detail to permit a wearer to determine a horoscope or the likely outcome of a particular event. Any such assembly should preferably include a digital display and a representation of the signs of the Zodiac and other planetary bodies of the solar system in a movable array, and more preferably, should also incorporate a fixed depiction of the twelve "Houses" of the Zodiac, all within a casing structured and designed to be wearable in wristwatch form. It would also be preferable to package any such assembly in combination with a simplified astrological guide in order to facilitate the understanding of astrological movements and the interpretation of that information in order to arrive at a prediction for the outcome of a particular event and/or negative or positive influences for a known period of time. Any such assembly should also be accurate in terms of calculating the planetary movements and orbits to an extent sufficient to not only promote the interest of curious amateurs but to be relied upon by experienced astrological forecasters.

SUMMARY OF THE INVENTION

The present invention is designed to address the needs which remain in the art and relates to a celestial timepiece assembly, preferably in the form of wristwatch type of structure that is sized and configured to be mounted on the wrist or other convenient location on the user's body. In the preferred embodiment, the celestial timepiece of the present invention is digitally operative and includes a central processing unit ("CPU"), which may be in the form of a microprocessor specifically sized to be carried within a casing replicating a wristwatch type of structure. In its simplest form, the present invention may be used to maintain and display local time as well as the date and preferably, geographical location.

More specifically, the present invention includes a casing sized and configured to correspond to a substantially conventionally sized wristwatch wherein the casing includes some type of connecting band or strap to be mounted most preferably about the wrist of the user. The present invention further includes a display surface and a display assembly connected or coupled to the casing. The display surface preferably comprises an annular band formed of the same rigid material as and integral with the casing, and presents a generally flat surface for viewing. A cover member formed of a rigid yet clear material can be provided with the casing and disposed so as to overlie and protect the display assembly. The display assembly is preferably a liquid crystal display (LCD) which is clearly viewable through the cover member, if one is provided, and further, is preferably centrally disposed on the casing, at a center region adjacent to the display surface, and effectively defines a majority of the exposed surface of the casing. In order to accomplish digital activation of the display assembly, it is connected either directly or indirectly through conventional circuity to the workings of the CPU. The CPU or processor is electronically structured and disposed to incorporate and/or to communicate with a plurality of databases, each having means or appropriate memory facilities for the storage and maintenance of a variety of different information. Further, the CPU and the provided databases are structured and disposed to be cooperatively responsive with one another so that the variety of different information, including certain additional information which is inputted into the CPU, can be organized and stored in various pre-determined categories. As such, the CPU is structured and disposed to access, process, receive and/or transmit stored information to the display assembly, whereupon certain astrological information from one or more of the pre-determined categories is displayed in movable paths of travel on segregated portions of the display assembly, which in turn, are viewable through the exposed surface of the casing.

A first pre-determined category of astrological information preferably comprises an array of signs corresponding to the Zodiac, with each sign preferably being displayed and disposed along an outermost, annular periphery of the display assembly, and further, with each sign being movable therealong in what may be defined as a first viewable path. A second pre-determined category of astrological information comprises an array of symbols, each corresponding to one of a plurality of celestial bodies and/or planets, and the movement of each relative to earth, as defined by an ephemeris structured to calculate the positions of each of the plurality of celestial bodies and/or planets during their ordinary sequence of movement on various dates throughout a pre-determined time period of at least one, but preferably a plurality of years. Further, the second predetermined category of astrological information is also preferably displayed on the display assembly, preferably along a second annular region thereon, concentric and adjacent to the first viewable path, in what may be referred to as a second viewable path. Preferably, each symbol for a planet or celestial body is movably depicted along this second path, with the movements of each being responsive to the CPU and ephemeris so as to generally correspond with actual planetary movements in a relatively accurate fashion. Also, it is preferred that this second path or inner annular band move relative to the first path, such that the various positions of the planets, shown movable relative to one another, are also depicted moving relative to the various signs of the Zodiac which define the first pre-determined category of astrological information. A third pre-determined category of astrological information preferably comprises an array of "Aspect" lines, each of which is preferably disposed in a substantially central portion of the display assembly, in surrounded relation by both the annular bands of the first and second paths, as set forth above. Preferably, this third pre-determined category of information will be only selectively displayed, as about to be explained.

The present invention also comprises activating control means. These may include a control assembly structured and disposed to permit the selection and/or inputting of data to the CPU, such as but not limited to the time of a particular geographical location, the name and place of that particular geographic location and/or its latitude and longitude, etc. In addition, the control assembly is further structured and disposed to activate the CPU so as to selectively display certain information on the display assembly. Preferably, the CPU will be programmed to include a "default" mode whereby it transmits for display on the central portion of the display assembly, the time, geographic location and date thereat, which can be selectively altered by manipulation of the control assembly. In this embodiment, the control assembly can be manipulated, whenever that is desired, to cause the CPU to interrupt the "default" mode and to preferably display the third category of astrological information defined by the aforementioned visual array of "Aspect" lines.

With respect to the third pre-determined category of information, each "Aspect" line preferably extends between the symbols corresponding to two planets or celestial bodies, and also, preferably displays an indicating symbol which relates to the angular orientation between those two planets or celestial bodies. That is, the CPU of the present invention is structured and disposed to calculate the angular orientation between the planetary bodies displayed on the display assembly, and further, to present for display a pre-selected indicating symbol, adjacent substantially each Aspect line, at some point along the length thereof. The indicating symbol displayed adjacent each Aspect line preferably is determined by the angular orientation of the Aspect line, as it is generated from one planetary body to another. Further, the indicating symbol will preferably identify the angular orientation of the Aspect line as at least the following: "conjunction", "opposition", "trine", "square", and "sextile". Each of the aforementioned angular orientation identifiers is pre-determined for the indication of whether there is a favorable or positive influence versus an unfavorable or negative influence surrounding a particular situation that the user may wish to "ask" about, in hopes of predicting the outcome of an event or the like.

In addition, the display assembly preferably has a generally circular configuration which further, is divided into twelve equally dimensioned segments of generally about thirty degrees each. Collectively, the plurality of segments, which are twelve in number are defined into an annular band or circle of 360 degrees. Each of these segments represent a particular "House" of the Zodiac, and in accordance with astrological teachings, each "House" has a particular theme, meaning that it influences a particular subject of life, such as financial matters, family matters, romantic matters, etc.

Finally, it is preferred that the body of the casing, and in particular, an outer periphery thereof adjacent to the display assembly, include indicia thereon to provide directional indicators such as North, South, East and West.

Accordingly, a primary object of the present invention is to provide a celestial timepiece assembly, preferably in a form which generally resembles a wristwatch so as to be capable of being conveniently carried on the person of the wearer, which is operable to indicate at least a current date and time for a particular location, as well as to display certain astrological information relating thereto.

Another primary object of the present invention is to provide a celestial timepiece assembly having a central processing unit, preferably a microprocessing unit, coupled to a battery or other power source, and a digital display, so as to cause the watch to operate and to digitally display at least a date and time for a particular geographical location, as well as information on the location of one or more of the constellations of the Zodiac and other planetary bodies, based on the date and time of that particular geographical location.

Yet another important object of the present invention is to provide a celestial timepiece which incorporates a display assembly that movably depicts a plurality of various categories of astrological information, such that the categories of information can easily be both read by a person and correlated to one another so as to enable that person to easily determine whether the planetary influences are "favorable" or "not favorable" in terms of the desired outcome of a future event.

Still another important object of the present invention is to provide a celestial timepiece assembly which, in addition to indicating a particular geographical location's date and time, allows the concurrent viewing of various categories of astrological information and the selective viewing of yet an additional category of astrological information so as to enable one to determine whether the planetary influences are either "favorable" or "unfavorable" in terms of a desired outcome of one or more future events.

It is also an important object of the present invention to provide a celestial timepiece assembly which in its simplest form will efficiently display a digital indication of a geographical location's date, time, and which in a more sophisticated mode of operation, will be capable of indicating a possible favorable or unfavorable outcome of a variety of events at any given time depending upon the locale of the user.

Yet another object of the present invention is to provide a celestial timepiece assembly which is attractive, economically feasible and which has a sturdy and durable construction so that it will be capable of having a long operable life.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
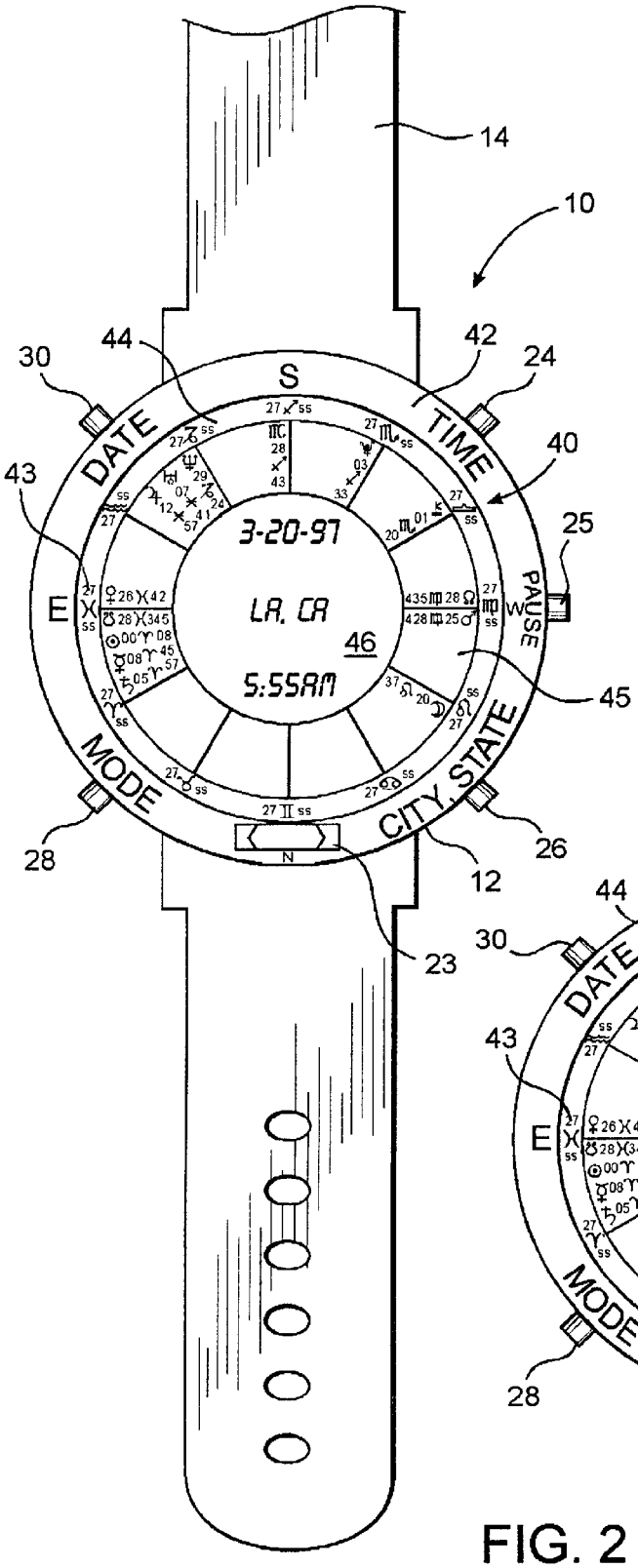
FIG. 1 is a front view of the celestial timepiece assembly according to the present invention depicting a first operative mode thereof.
Figure 2:
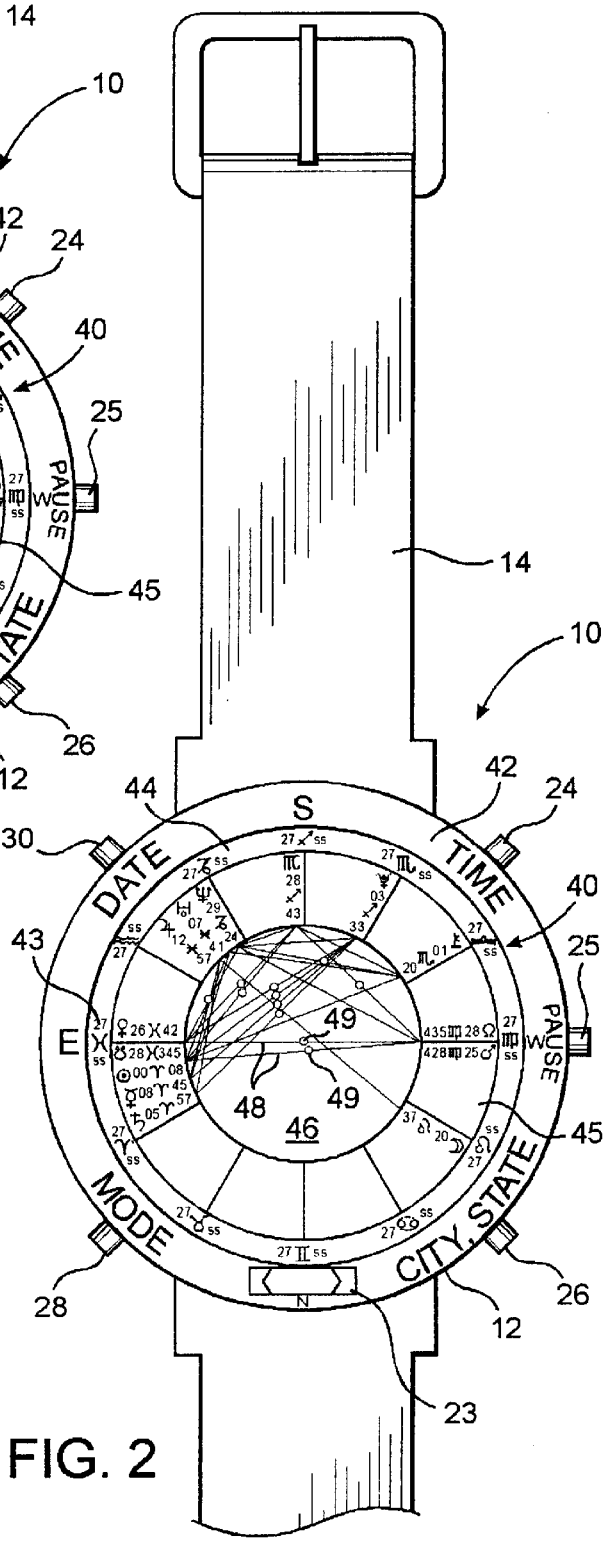
FIG. 2 is a front view of the celestial timepiece assembly illustrated in FIG. 1 and depicting a different operative mode thereof.

As perhaps is best shown in FIGS. 1 and 2, the present invention is directed towards a celestial timepiece assembly, and is generally indicated by reference numeral 10. More in particular, the celestial timepiece assembly 10 is structured and disposed to indicate at least a current time and date for a particular geographical location, as well as certain astrological information, to be described in greater detail hereinafter.

In the preferred embodiment, the celestial timepiece assembly 10 is in the form of a wristwatch comprising a casing 12, formed from a suitable material such as plastic or a rigid metallic material, and a flexible connecting strap 14 or a similar suitable structure designed to removably attach the casing 12 about the wrist of the wearer. It should be understood, however, that the present invention also contemplates a celestial timepiece assembly that may take other forms, for instance, a pocket watch or other wearable time clock or that it may also take the form of a more conventional clock which may be too large or too heavy to be conveniently carried on the body of the person utilizing the present invention.

With reference to FIGS. 1 and 2, the celestial timepiece assembly 10 preferably includes a display surface 42 and a display assembly 40, connected or coupled to the casing 12. As illustrated, the display surface 42 preferably comprises an annular band formed of the same rigid material as and integral with the casing 12 of the celestial timepiece 10, and which is structured and disposed to present a generally flat surface for viewing and to surround the display assembly 40. Ideally, the display surface 42 includes certain visual indications relevant to the accurate reading of the celestial information provided by the celestial timepiece 10. As illustrated in FIGS. 1 and 2, these visual indications preferably include directional indicators such as are found on a conventional compass, namely, North, East, South, West, or abbreviations therefor, such as "N", "E", "S", "W", although the arrangement of these indicators on the display surface 42 will be unconventional. That is, the directional indicators, such as East, South, West, North, are preferably arranged on display surface 42 in an inverted orientation relative to a conventional compass, so as to represent the viewing of the heavenly bodies from a position wherein one lies on the ground looking skyward with his or her head pointing to the North, as opposed to the directional indicators found on a conventional directional compass which are structured for travel over the earth's surface. Further, the visual indications on display surface 42 may also include and will preferably include certain operating indicators such as "Date", "Time", "Pause", "City/State" and/or "Mode", the purpose of which will also be described in more detail, below.

In addition to the display surface 42, the celestial timepiece assembly 10 preferably includes a display assembly 40. As illustrated in FIGS. 1 and 2, the display assembly 40 is preferably centrally disposed on the casing 12, at a center region adjacent to and concentrically inwardly from display surface 42, and in a more preferred embodiment, effectively defines a majority of the exposed surface of the casing 12. The display assembly 40 is structured and disposed to display certain astrological information as well as to permit the selective displaying of at least a current local time and date, and certain additional astrological information, as will be described in more detail hereinafter. The display assembly 40 preferably comprises a liquid crystal display (LCD) operatively connected to a processor, described below, and further, which is structured and disposed to include a plurality of distinguishable segments. If desired, the display assembly 40 may be provided with a cover member formed of a durable transparent material to both protect the preferred LCD from damage and yet facilitate viewing of the display assembly 40.

Figure 7:
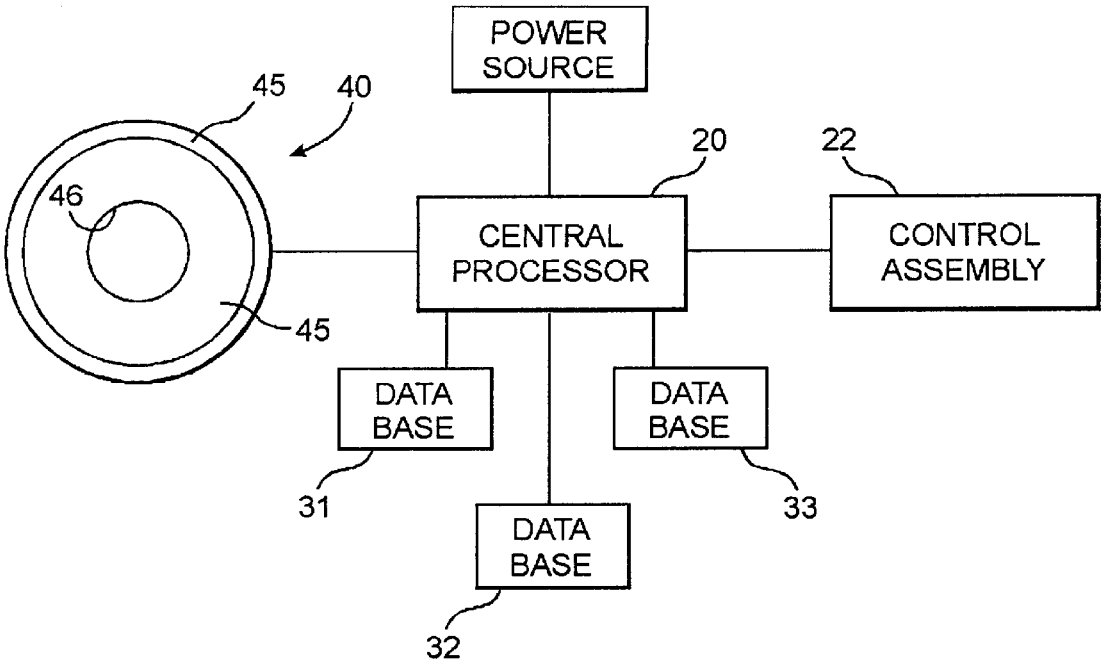
FIG. 7 is a block diagram which represents one embodiment of the present invention.

With reference now to FIG. 7, the celestial timepiece assembly of the present invention is seen to additionally comprise a processor or central processing unit (CPU) 20 programmed to receive, organize, operate and transmit all information pertinent to performing the intended functions of the present invention. A suitable CPU can comprise, for example, an individual chip, such as one of Intel Corporations 80226, 80386, 80486, or 80586 chip series. Ideally, the CPU 20 comprises a microprocessor or microprocessing chip dimensioned to sufficiently fit within an interior region of a casing 12 forming the preferred wristwatch embodiment for the invention. The CPU 20 additionally includes memory means for storing the program or software to be executed by the CPU as well as certain additional information (including data) to be inputted into the CPU 20 by a user. Examples of suitable CPU associatable memory means include the random access memory (RAM) such as is commonly associated with a CPU and the like. The CPU 20 also includes means for outputting information and/or data to the display assembly 40, preferably in the form of the Liquid Crystal Display or LCD, discussed above, and related circuitry for operably connecting or interconnecting with same to accomplish the display of desired information. In addition, the present invention includes a power source, preferably one or more small batteries, such as a long life Nickel-Cadmium battery housed within the casing 12 and in electrical communication with the CPU, so as to supply power to the CPU and the celestial timepiece assembly 10.

Further, the CPU 20 is operably connected to means for inputting information which preferably comprise at least one control assembly 22. That is, certain data, important to the operability of the timepiece 10, can be inputted into the central processor or CPU 20 by way of at least one control assembly 22. In the preferred embodiment, however, and as illustrated in FIGS. 1 and 2, the control assembly 22 comprises a plurality of push button structures mounted on casing 12, as designated by reference numerals 24, 26, 28 and 30. The preferred control assembly comprising push button structures 24, 25, 26, 28 and 30, are also disposed in an accessible location on the casing 12, such as on a periphery thereof so as to readily permit the wearer to physically manipulate them, such as with his or her finger(s). In this regard, adjacent each push button structure the display surface 42 preferably includes at least one operating indicator such as "Date", "Time", "Pause", "City/State" or "Mode", described previously, correlated to visually indicate the function of that particular push button structure. Further, the control assembly 22 and/or button structures 24, 25, 26, 28, and 30 is/are structured and disposed to be in operative communication with the CPU 20 so as to permit the effective input of data and/or information thereinto, and preferably, into the program or software being operated by the CPU 20. Also in the preferred embodiment, at least one button structure of the control assembly 22, such as "Pause" button 25, is structured and disposed to activate the celestial timepiece assembly 10 in terms of choosing between a continuous or temporary display on the preferred LCD of the display assembly 40 of either a current local time and date or various categories of information related to the astrological presentation. Still referring to FIG. 7, the software or computer program being operated by the CPU 20 may also include one or more databases 31, 32, 33, each of which is representative of a different category of information. A first database, designated by reference numeral 31 may be structured to store certain astrological information corresponding to planetary bodies such as but not necessarily limited to the sun, moon, nine other planets of our solar system and the constellations of the Zodiac, and further, will preferably store a designated symbol for each planet and/or sign of the Zodiac. A second database 32 may be structured to store certain additional astrological information relating to the orbital paths followed by each of these planets and/or constellations over a defined period of time, and as such, will preferably comprise at least one ephemeris, i.e., one or more table(s) giving the coordinates of one or a number of planets and celestial bodies at a number of specific times during a defined period, ideally for at least one year, but which could also be for more, such as generally about 5 to 7 years. A third database 33 may be structured and disposed to store certain additional astrological information relating to the angles of separation between any of the planetary bodies stored within the first and second databases, at any given time, and the visual depiction of a plurality of "Aspect lines" between the various planetary bodies. This third database 33 may also be structured and disposed to store a plurality of indicating symbols, each of which correlates to a particular angle or degree of separation between two planetary bodies. While each of these categories of information will be explained in greater detail hereinafter, it is pointed out at this juncture that the CPU 20 is structured and disposed to access these databases either in sequence or simultaneously and to perform certain calculations. By way of example, by virtue of these databases and the program(s) run on the CPU 20, the location of two particular planets can be determined at a particular time by utilizing the ephemeris of the second database, and further, the "Aspect" or "Aspect line" between those two particular planets can be also be determined by calculating the geometric angle between the two particular planets at that particular time. In accordance with astrological teachings, the geometric angle between a selected two planets or celestial bodies, as further described herein, offers the ability to determine whether a favorable or unfavorable influence is likely to be exerted at that particular time, for a given subject matter.

Further with regard to FIG. 1, the central processor 20 is further structured to include sufficient storage capabilities to maintain a program and/or database which preferably comprises an atlas of many predetermined geographical locations, such as but not limited to, some 200 or more cities located within the United States, and the latitude and longitude associated with each location, and further, a program and/or database which comprises a conversion table between Greenwich Mean Time ("GMT") and the current local time at one of the various pre-determined geographical locations, so as to correlate information stored as part of the ephemeris in the second data base, which typically is set for GMT. It should be pointed out that many other geographical locations throughout the world may be inputted and stored into the program and/or database of the central processor 20, and/or that the latitude and longitude coordinates of a particular geographical location could be inputted instead. As set forth above, all of the aforementioned data can be inputted through physical manipulation by the user of the control assembly 22, which preferably comprise the access buttons 24, 26, 28, and 30. In addition, the control assembly 22 may include a fine tuning control facility, such as indicated by reference numeral 23, which is structured and disposed to provide a menu and for the scrolling display and selection of the various cities, months, days, years, hour, minutes, etc. Thus, the fine tuning control facility 23 may also be considered as part of the control assembly 22 for regulating the input, for example, of the specific time and/or date depicted on the display assembly, as will be explained in greater detail hereinafter. Also, the control assembly 22 may incorporate a push button structure, 25, marked on the casing 12 near the indicator "Pause," to temporarily "stop" the time calculations of the CPU while the user momentarily performs another function with the assembly 10.

Referring again to FIGS. 1 and 2, the display assembly 40 of the present invention will now be described in greater detail. As illustrated, in the preferred embodiment, the display assembly 40 is structured and disposed to have a generally circular configuration and further, to display a plurality of segments in fixed, non-movable form. Most preferably, the plurality of segments are twelve in number, each being equally dimensioned to another, and collectively defined in an annular array or circle of 360 degrees. Each of these segments corresponds to about 30 degrees and represents a particular "House" of the Zodiac, and in accordance with astrological teachings, each "House" has a particular theme, as set forth on FIG. 3.

In addition, the display assembly 40 is structured and disposed to depict a plurality of segregated, viewable paths. A first viewable path is indicated by the reference numeral 44 and is seen to comprise a generally annular band disposed about the outer periphery of the display assembly 40. This first viewable path 44 is structured and disposed to ideally present each symbol corresponding to each sign of the Zodiac, and further, with each symbol being movable incrementally along and about the annular band defining the first viewable path 44. Ideally, each symbol moves therealong in a clockwise direction from a station adjacent one of the fixed segments defining a "House", described above and in more detail below, to another station adjacent the next segment defining a preceding "House," (in that the segments defining the various Houses of the Zodiac are read in a counterclockwise direction starting from the reference letter "E" for East where the first House is located). The movement of these signs preferably serves to track and is consistent with the timing of the corresponding Zodiac sign's stellar movement along its orbital path relative to and about the earth. In this regard, the preferred symbols for each sign of the Zodiac which appear along the incrementally moving visual first path 44 are represented in the table illustrated FIG. 4. The table of FIG. 4 further indicates the planetary ruler associated with each of the Zodiac signs, for a purpose which will become more clear from the discussions below.

More specifically, and as has been described, the display surface 42 includes certain visual indications relevant to the accurate reading of the celestial information provided by the celestial timepiece 10. As illustrated in FIGS. 1 and 2, these visual indications include directional indicators such as are found on a conventional compass, namely, North, East, South, West, or abbreviations therefor, such as "N", "E", "S", "W". The reference letter "E," representing the directional indicator "East" is an initiating point of reference in that it preferably defines a "point of ascension" for the reading of the astrological information. That is, for any given city or other geographical location on earth, there is an eastern horizon and as the earth rotates, one or more of the various constellations of the Zodiac and other planetary bodies are ascending on that horizon, at any given time, whether day or night, and then, are continuously moving across the heavens, relative to earth, and even relative to each other. With respect to the assembly 10, the letter "E" then is preferably a starting point for the reading the astrological information, and even for the reading of the various fixed segments corresponding the various "Houses" of the Zodiac. That is, once the CPU has been programmed and has received and stored the inputted information, and in particular with respect to the user's particular geographical location and time, the CPU will access the various information within the databases and will transmit the accessed information to the display assembly 40 for display of the generally accurate positioned of the planets and constellations. At any given time, a user will know what planets and constellations are ascending on the eastern horizon at that particular location, and the general location of other planets and constellations relative thereto.

Returning to the first viewable path 44, the depiction of each sign of the Zodiac preferably moves along the annular band defined thereby in accordance with the "equal" House system, wherein each House occupies generally about 30 degrees, of the circular display as described above. If desired, positioned adjacent to each sign of the Zodiac on first viewable path 44 can be displayed a certain number, indicated by reference numeral 43 in FIGS. 1 and 2, which for purposes of this example is the number "27". This number represents a more accurate position of the given sign of the Zodiac as it passes through a particular House by displaying the degrees of the specific location of a given sign. In this example, the numeral 27 indicates that the sign of the Zodiac has three more degrees to reach 30 degrees, whereupon it will pass completely through the House indicated and into the next House. Additional numbers may also be located adjacent a given sign which is indicative of the "minutes" thereby giving an even more precise indication of the exact location of a sign within a given House as it passes therethrough.

In the preferred embodiment, the display assembly 40 is also structured and disposed to depict a second viewable path 45. The second viewable path 45 is preferably defined in part by the fixed display of the twelve equally dimensioned segments in a circular array, which as discussed above are intended to represent twelve equal "Houses" of the Zodiac. Preferably though, this second viewable path 45 is also defined by the movable display of a plurality of symbols, each of which corresponds to a particular planet or constellation. The location of each symbol representing a planetary body is preferably determined with the aid of an ephemeris, as has been described with reference to the second database. An ephemeris comprises a table which provides the positions of a plurality of celestial bodies and planets throughout one or more years, wherein the planets or celestial bodies are represented during their ordinary sequence of movement relative to one another. Accordingly, the second viewable path 45 is also preferably in the form of annular band disposed concentrically inward from the first annular path 44, and further, is structured and disposed to present each of the symbols corresponding to the planets and in certain embodiments, the signs of the Zodiac wherein the symbols/signs are continuously movable along the annular band 45 in a clockwise direction, in a manner which tracks and is consistent with the timing of the corresponding planet's movement along its orbital path, in accordance with the ephemeris.

Still referring to FIGS. 1 and 2, in the preferred embodiment the display assembly 40 also includes a third viewable area, namely, a central display area, designated by reference numeral 46. As shown in FIG. 1, the central display area 46 is preferably structured and disposed to display at least the time, and preferably, also the date and geographical location of the user. The central display area 46 could also be blank, until such time as it is desired to read the date and time or other astrological information, whereupon a user may manipulate the control assembly. More specifically, a user can manipulate one of the control assembly buttons, such as 28, and thereby, activate the CPU 20 so as to change the display presented on the central display area 46. In a preferred embodiment, the CPU 20 is programmed to return continuously to a "default mode" wherein the date, time and geographical location of the user are displayed on central display area 46, until such time as the user desires to view additional astrological information. Preferably, whenever that is desired, the user easily manipulates one of the control assembly buttons, and the CPU in response changes the information presented on central display area 46, ideally to a depiction of a plurality of "Aspect" lines 48, as shown in FIG. 2. As has been described previously, each "Aspect line" relates to an angle of separation between a selected pair of planetary bodies, which angle can be identified as one of those appearing in the table of FIG. 5. In that vein, and as will be discussed subsequently, it is important which two planet or planetary bodies are selected for evaluating the "Aspect" line between them, meaning that the user will have a particular subject matter on which he or she is inquiring about and consequently, will evaluate the "Aspect" line between "controlling" planets for that particular subject matter, in order to determine whether there is a positive or a negative influence being exerted at that time.

Figure 5:
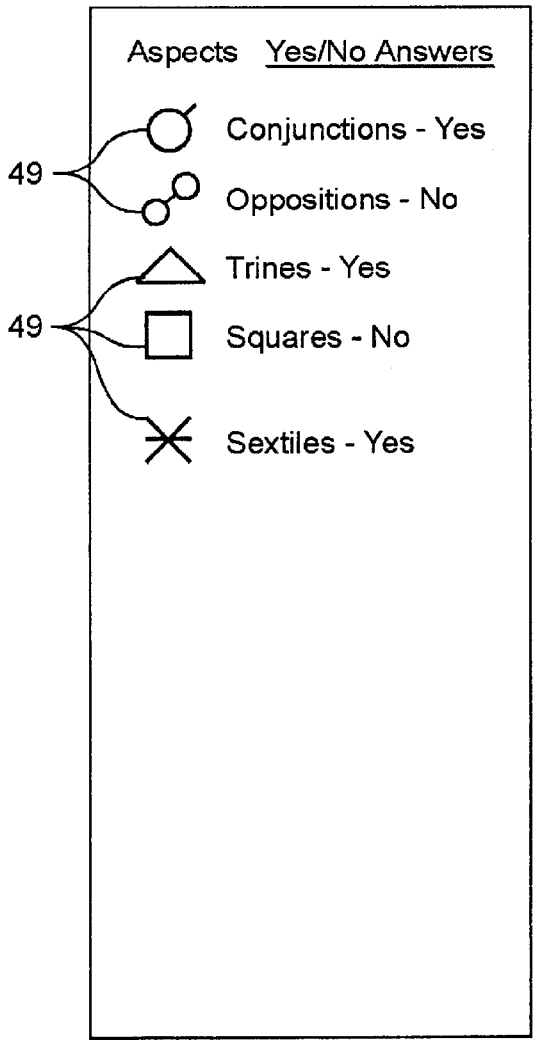
FIG. 5 is a table illustrating the indicator symbols for an "Aspect" line as well as the corresponding angular orientations between two planetary bodies, which are useful for determining whether the influence exerted is either "YES" for "favorable" or "NO" for "unfavorable," at a given time and date.

To aid a user with knowing the angular orientation between two such planets, the display assembly 40 is more preferably structured and disposed to also present a plurality of viewable symbol designations 49, each of which corresponds to a particular angle of separation, as shown on the table of FIG. 5. Preferably, one of these viewable symbol designations 49 will appear adjacent to each of the plurality of "Aspect" lines 48, so as to correctly identify the angle between a selected pair of planets/constellations at a given time. These viewable symbol designations 49 are as depicted in FIG. 5 and represent the specific angular orientation of each of the "Aspect" lines between "controlling" planets or constellations. By way of example, and with reference to FIG. 2, the angular orientation between the planets Mars and Neptune is 120 degrees, and accordingly, the viewable symbol designation 49 for a triangle appears at the "Aspect" line between these two planets so as to identify the angle represented as "trines," which is a favorable indication or a positive influence. As another example, and still referring to FIG. 2, the angular orientation between the two planets Pluto and Uranus is 60 degrees, and accordingly, the viewable designation symbol 49 appears at the "Aspect" line between them, which symbol is an asterisk like symbol which corresponds and identifies a "sextiles" designation, seen in FIG. 5, also believed to exert a favorable or positive influence. On the other hand, and still referring to FIG. 2, an angular orientation of "180 degrees" for an "Aspect Line" between two controlling planets such as the Sun and Mars, for instance, is interpreted to be an "opposition," which is believed to exert an unfavorable or negative influence, and accordingly, the appropriate symbol from FIG. 5 would appear on the "Aspect" line between these two planets. Similarly, an angular orientation of "90 degrees" for an "Aspect Line" between two controlling planets such as Uranus and Chiron is interpreted to be a "squares," which is believed to exert an unfavorable or negative influence, and in that example, a square symbol would appear adjacent the "Aspect" line extending between these two planets. As also indicated in FIG. 5, another viewable symbol designation 49 may be provided to represent a "conjunction," which is indicative of a favorable response. However, a conjunction arises when there is an angular orientation of zero degrees between two selected or controlling planets. In that "Aspect" lines between controlling planets having no effective separation or a zero degree separation, the "Aspect" line would preferably not be visible on the display assembly 40 of the timepiece 10. Accordingly, there is no representation for the viewable designation 49 of a "conjunction" on the embodiment of FIG. 2.

By permitting the visualization of the "Aspect" line for a selected pair of planets, a person can determine whether the planets are likely to influence the outcome of a future event in a favorable or unfavorable way. More in particular, the celestial timepiece assembly 10 readily permits the selective viewing of an appropriate symbol designation 49, seen in FIG. 5, on each of the "Aspect" lines 48, and as a result, when the user wishes to become informed as to the likely outcome of an event, the subject matter of which is defined by one of the controlling planets of the House being asked about, either a favorable ("YES") or unfavorable ("NO") outcome can be gleaned. In the preferred embodiment, the various viewable symbol designations 49 will appear automatically adjacent each "Aspect" line as a result of the CPU 20 performing calculations as to the location of two particular planets at a particular time utilizing the ephemeris of the second database, and as to the geometric or "geo centric" angle between those two particular planets at that particular time, and as a result of the CPU and related circuitry being structured and disposed to automatically send the resulting image in digital display form to the central display area 46 for display.

Figure 3:
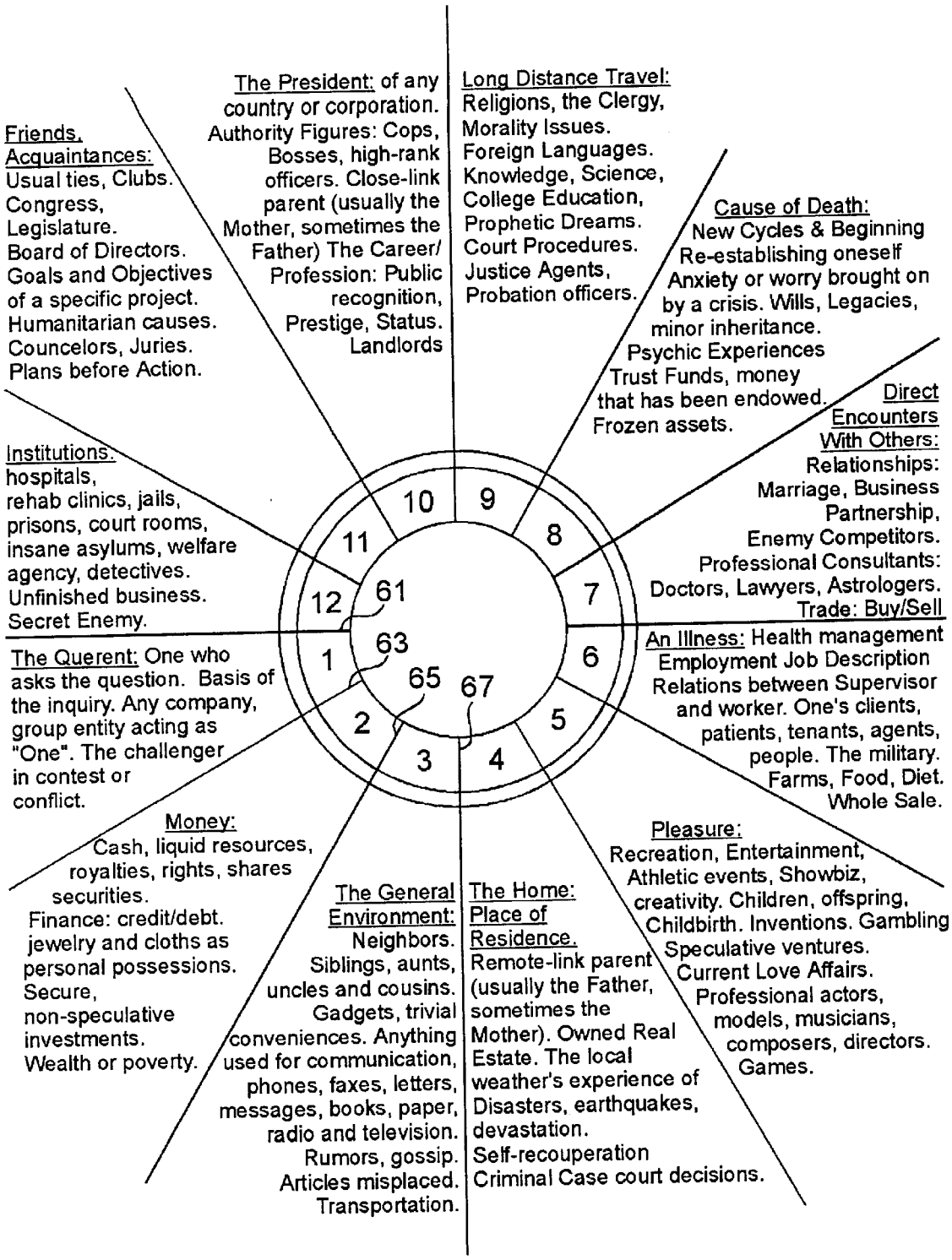
FIG. 3 is a schematic representation of the twelve "Houses" of the Zodiac, with an indication as to the subject matter believed to be controlled by each House.

Referring to FIGS. 1 and 2, it should be pointed out again that the twelve "Houses" of the Zodiac are preferably represented as being fixed in terms of their relative positions to one another on the display assembly 40. More in particular, and as illustrated in FIG. 3, astrological teachings suggest that each "House" corresponds to or has domain over a particular subject matter, and in order to obtain a generally accurate prediction of a particular event, the user will want to refer to the "House" for that particular subject matter. Further, the "cusp" of each House is preferably represented on the display assembly 40 by a fixed dividing line, such as 61, 63, 65, 67, etc. representing the cusp of Houses 1, 2, 3, 4, etc., respectively, as shown in FIG. 3. Also, and with reference to the preferred wristwatch embodiment depicted in FIGS. 1 and 2, beginning with initial point of reference indicated by the letter "E" (for East) on the casing 12, which represents the point of ascension, each of the twelve Houses extends through an arc or segment of generally 30 degrees, such that the twelve houses collectively define an annular or circular array of 360 degrees, as also depicted in FIG. 3, which can also be conveniently depicted on the face of a clock or the preferred wristwatch 10.

If a person wishes to utilize the celestial timepiece assembly 10 of the present invention to inquire about a particular issue, he or she will need to determine the "House of Origin" for that issue. By way of example, if the user wants to inquire about the subject of money or finances, then the "House of Origin" for that issue, as can be determined from FIG. 3, is the second (2nd) house. Next, the user will want to determine which planet or planetary body is the "controlling" planet of the selected House of Origin, whichever planet that may be depending upon the specific current time and geographical location of the user. Thereafter, the user will determine what House is the "Opposite House" to the "House of Origin" or the House disposed opposite 180 degrees thereto. Continuing with the example of an inquire on finances, meaning that the 2nd House is the House of Origin, then the "Opposite House," in this case is the 8th house, which relates to subject matter for the endings of a cycle, more commonly referred to as the "Cause of Death." Here again, the user will next determine which planet is the "controlling" planet for that "Opposite House," which will vary depending upon the particular time and geographical location at which the inquiry is being made. Finally, the user would then locate these two "controlling" planets, preferably on the second viewable path 45 and would then consult the "Aspect" line which extends between those two planets, which preferably is displayed on the central display area 46, with the angular orientation between them calculated by the CPU 20 and further displayed by the CPU with an appropriate one of the viewable symbol designations 49, set forth in FIG. 5, displayed closely adjacent the "Aspect" line.

Figure 6:
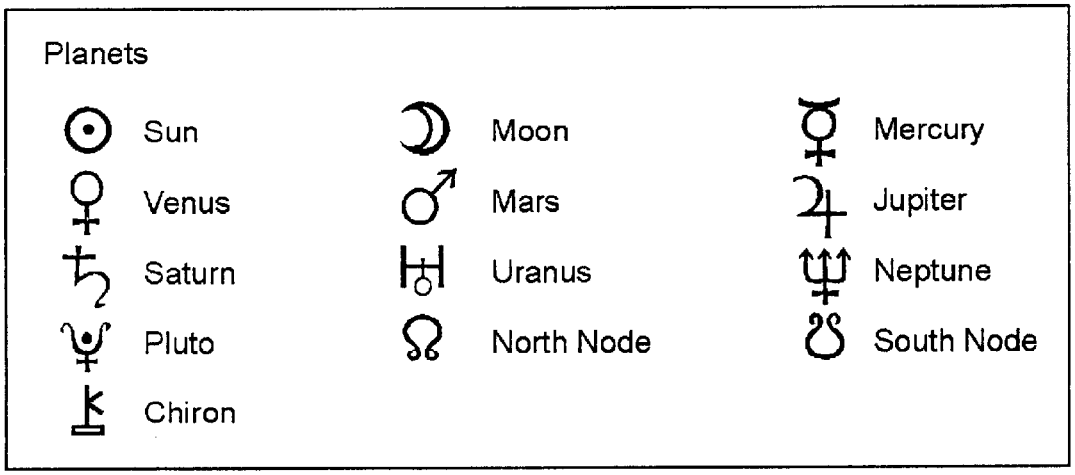
FIG. 6 is a table illustrating the symbols which correspond various planets and celestial bodies within the Zodiac.

With reference to FIG. 6, the various visual designations representative of the planetary bodies such as the Sun, Venus, Saturn, Pluto, Chiron, etc., are represented. As describe above, the designations for these planetary or celestial bodies preferably appear on the second visual path 45 of the display assembly 40 and more preferably, will appear to travel thereacross in a clockwise movement, similar to the various signs of the Zodiac which move incrementally within the first viewable path 44. However, in actuality the relative positioning and movement of the celestial bodies or planets indicated by the designations in the Table of FIG. 6, move counterclockwise at a much "slower" pace but, as set forth above, appear to be "carried along" with the clockwise movement of the zodiac array of the first viewable path 44.

Once the celestial timepiece assembly 10 has been "set" through the input of a current local time, date and geographical location by manipulation of the various activating buttons 24, 26, and 30, the viewable first and second paths 44 and 45 begin to move in synchronization, based on the current local time. It should be appreciated that the planets displayed as traveling along second visual path 45 in accordance with an ephemeris, discussed previously, travel at their individual velocities, and further, that the first viewable path 44 comprised of the Zodiac signs makes a complete circular rotation once every twenty-four hours. Therefore, a user of the celestial timepiece assembly of the present invention would visually be able to discern an apparent rising and setting of the various planets as well as constellations of the Zodiac, which in reality is the turning of the Earth about its axis every twenty-four hours.

To operate the celestial timepiece 10, a first preferred step involves a user entering data into the CPU 20, which is accomplished by manipulation of one of the buttons 24, 26, 30 of the control assembly 22. Ideally, the celestial timepiece 10 can be purchased with the CPU previously programmed with the various databases, 31, 32, 33 and as otherwise described previously, such that this initial step merely involves locating the city name or other geographical indicator name for where the user is located, such as by scrolling through a series of displayed city names presented on the central display area 46, and then entering a selected city name by means of the fine tuning control facility 23. Both the current local time and date for that geographical location will automatically be input and/or indicated by appropriate control buttons 24 and 30. Next, the user should become familiar with the various signs representing the constellations of the Zodiac shown in FIG. 4, the symbols representing the various planetary bodies, shown in FIG. 6, the symbols for angular orientations between planets or "Aspects," as set forth in FIG. 5 with their respective "YES/Positive" or "NO/Negative," influences, and further, with the various "Houses" of the Zodiac, and each's attendant subject matter, as illustrated in FIG. 3.

As has been described, the preferred wristwatch embodiment of the present invention displays as a default, the current local time and date for and the name of a geographical location, on the central display area 46. When the user desires to access information regarding a given subject or to inquire about a future event, he or she will preferably interrupt the above-described preferred display mode of the wristwatch, ideally causing it to pause momentarily, by manipulating the control assembly, such as push button structure, 28, at any given time.

The central display area 46 of the display assembly 40 is then activated by the CPU 20 so as to be selectively changed from the information depicted in FIG. 1, to that of FIG. 2, wherein the plurality of "Aspect" lines 48 are displayed. As set forth above, the "Aspect" lines 48 will serve to interconnect planets, in order to provide a visual indication of their angular orientation to one another, and the appropriate symbol designation 49 for that angle will also appear adjacent the pertinent "Aspect" line. From that, the user will arrive at an answer which indicates that the planets are exerting either a favorable/positive influence on that issue or an unfavorable/negative one, which should be determinative at least in a general sense of the user's inquiry.

In another embodiment of the present invention, it is contemplated that celestial timepiece assembly 10 will be structured so as to not depict certain information such as, but not limited to, date, time, location, etc. While such information is important for the accurate determination of certain astrological information including the presentation of the "Aspect" lines 48 and the viewable symbol designations 49 thereon, it may be desirable, in certain instances to present an assembly 10 which, in fact, computes the local, current date and time through the operation of the CPU 20 but does not display such information. In such an embodiment, the central display area 46 may be left blank or may depict certain fanciful designs as well as other representations or indications until activated to display the aforementioned and described "Aspect" lines 48.

Figure 4:
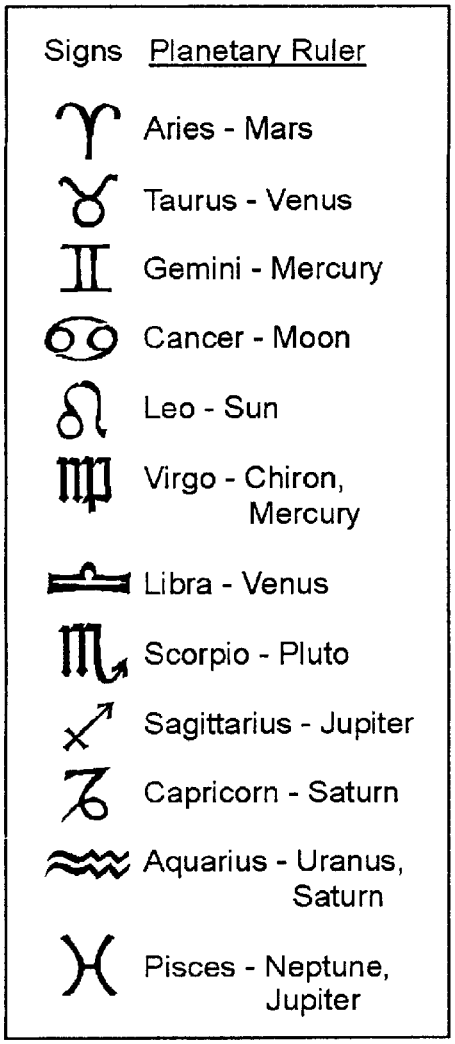
FIG. 4 is a table illustrating the symbols for various signs of the Zodiac with the associated planetary ruler listed for each sign.

To provide a more detailed description of the manner of operating of the celestial timepiece assembly 10 so as to aid with predicting the likely outcome of a particular event, the following steps should preferably be followed:

1. Locate which of the twelve Houses of the Zodiac pertains to the subject matter about which the user desires to inquire, as indicated in FIG. 3, and locate that House as the "House of Origin" on the second visual path 45, which will be represented by the fixed segments appearing thereon.
2. Take notice of the sign of the Zodiac located on the "cusp line" (61, 63, 65, 67, etc.) of the pertinent "House of Origin," and determine the planetary ruler for that sign of the Zodiac, as indicated in the table of FIG. 4.
3. Look for the "Opposing House" to the "House of Origin" by looking for the House which is disposed six spaces or 180 degrees away from the "House of Origin," also on the second visual path 45, as this "Opposite House" will be used to establish the answer or likely outcome for that particular subject matter.
4. Take notice of the symbol for the Zodiac sign which is placed on the cusp of the "Opposite House" and determine the planetary ruler of that sign, by referring to the Table of FIG. 4.
5. Take notice of the "Aspect" line interconnecting the first controlling planet of the "House of Origin," identified in step 2, above, with the second controlling planet of the "Opposite House," identified in step 4, above, and note the angular orientation, and in particular, the displayed one of the various symbol designation 49, consulting if necessary, the table depicted in FIG. 5.
6. Should the displayed one of the symbol designations 49 be one of the three which equate with a "YES", this is an indication that the likely outcome of the event asked about or of an intended act will be favorable.
7. On the other hand, should the controlling planet from the "house of origin" (or house of inquiry) form an unfavorable "Aspect" to the second planet controlling the opposite house, the symbol designation 49 displayed will be one of the two equating with a "NO"

answer meaning that the outcome of one's intention to act would be unfavorable.

8. If no "Aspect" line forms between the two or related controlling planets, the problem is shown to be too involved for direct "yes" or "no" answers or there is a "0 degree" of separation between the controlling planets. In such an event, further analysis is required.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly designed to compute and indicate time and current time related astrological information, said assembly comprising:

a) a casing including a display face defining an exposed surface thereof, said display face separated into a plurality of fixed segments, b) a display assembly mounted on said casing and viewable through said display face, c) a central processor sized to be mounted within said casing and structured to compute at least a current time of day and predetermined astrological information, d) said display assembly responsive to said central processor and cooperatively structured therewith to movably and concurrently depict at least a first category and a second category of said predetermined astrological information relative to one another, e) said display assembly being further responsive to said central processor and cooperatively structured to selectively display the current time of day or a third category of the predetermined astrological information, and f) a control assembly connected in activating relation to said central processor and cooperatively structured therewith to input current initiating data to said central processor.

2. An assembly as in claim 1 wherein said first category of predetermined astrological information comprises an array of zodiac signs movable along a viewable first path of said display assembly.

3. An assembly as in claim 2 wherein said first path comprises an annular band depicting each of a plurality of the zodiac signs in equally spaced relation to one another and collectively movable in a clockwise direction continuously relative to said display face.

4. An assembly as in claim 2 wherein said second category of predetermined astrological information comprises an ephemeris array movable along a viewable second path of said display assembly.

5. An assembly as in claim 4 wherein said second path comprises an annular band depicting the location of a plurality of planets relative to said array of zodiac signs of said first path.

6. An assembly as in claim 4 wherein said third category of astrological information comprises a visual array of a plurality of aspect lines, each of said aspect lines disposed to depict related positioning of controlling planets of said ephemeris array.

7. An assembly as in claim 6 wherein said plurality of segments comprise twelve equally dimensioned segments each extending through an arc of 30 degrees and collectively arranged into a continuous configuration of 360 degrees, each of said segments representing a different astrological house.

8. An assembly as in claim 7 wherein said first and second paths are respectively defined by an outermost annular band and a concentrically disposed inner annular band.

9. An assembly as in claim 8 wherein said display assembly further comprises a central display area disposed in surrounded relation by said first and second paths of travel and further disposed in a viewable position substantially centered relative to said display face.

10. An assembly as in claim 9 wherein said display assembly area is further responsive to said central processor to display said third category of astrological information within said central display area.

11. An assembly as in claim 10 wherein said display assembly is further responsive to said central processor to display the current time of day and geographic location within said central display area.

12. An assembly as in claim 9 wherein said display assembly is further responsive to said central processor to display the current time of day and geographical location within said central display area.

13. An assembly as in claim 1 wherein said central processor comprises at least a first database for storage of an ephemeris calendar of at least one year.

14. An assembly as in claim 13 wherein said central processor comprises at least a second database for storage of a location table of a plurality of geographical sites by latitude and longitude designation.

15. An assembly as in claim 14 wherein said central processor comprises at least a third database for storage of a time conversion table of Greenwich mean time to equivalent local time at each of said plurality of geographic sites.

16. An assembly as in claim 15 wherein said central processor is further structured to cooperatively interact with said first, second, and third databases to directly determine current planetary positioning relative to a predetermined geographical local and current time at the geographical local.

17. An assembly as in claim 16 wherein said display assembly is responsive to and cooperatively structured with said central processor to continuously display a continuous changing and a relative positioning of said first category defined by an array of zodiac signs and said second category defined by planetary positioning in accordance with said ephemeris array contained within said first database.

18. An assembly as in claim 17 wherein said display assembly is responsive to and cooperatively structured with said central processor to generate and depict a plurality of aspect lines disposed in an interconnecting orientation between determinative planetary positions.

19. An assembly as in claim 18 wherein said display assembly is responsive to and cooperatively structured with said central processor to generate and depict a viewable designation formed on each of said aspect lines, each of said viewable designations being representative of an angular orientation of each aspect line relative to said determinative planetary positions interconnected by respective ones of said aspect lines.

20. An assembly as in claim 1 wherein said casing is in the form of a wristwatch.

21. An assembly as in claim 1 wherein said display assembly comprises a liquid crystal display.

22. An assembly designed to compute current time and related astrological information relative to a predetermined geographical local, said assembly comprising:

a) a casing including a display face defining an exposed surface thereof, said display face separated into a plurality of fixed segments, b) a display assembly mounted on said casing and viewable through said display face, c) a central processor sized to be mounted within said casing and structured to compute at least a current time of day and predetermined astrological information, d) said display assembly responsive to said central processor and cooperatively structured therewith to movably and concurrently depict at least a first category and a second category of said predetermined astrological information, e) said display assembly being further responsive to said central processor and cooperatively structured to selectively display a third category of the predetermined astrological information, and f) a control assembly connected in activating relation to said central processor and cooperatively structured therewith to input current initiating data to said central processor.

23. An assembly as in claim 22 wherein said first category of predetermined astrological information comprises an array of zodiac signs movable along a viewable first path of said display assembly;

said second category of predetermined astrological information comprises an ephemeris array movable along a viewable second path of said display assembly; and said third category of predetermined astrological information comprises a visual array of a plurality of aspect lines, each of said aspect lines disposed to depict related positioning of controlling planets of said ephemeris array.

24. An assembly as in claim 23 wherein said third category of astrological information further comprises a viewable designation formed on each of said aspect lines, each of said viewable designations being representative of an angular orientation of each aspect line relative to said determinative planetary positions interconnected by respective ones of said aspect lines.

* * * * *